United States Patent [19]

Parker

[11] Patent Number: 4,573,569

[45] Date of Patent: Mar. 4, 1986

[54] STORAGE AND DISPLAY CASE

[76] Inventor: Dolores V. Parker, 5042 Linda St., Venice, Fla. 33595

[21] Appl. No.: 624,275

[22] Filed: Jun. 25, 1984

[51] Int. Cl.[4] ..... B65D 5/52; B05C 17/00

[52] U.S. Cl. ..... 206/1.7; 206/45.18; 206/45.19; 206/45.2; 206/362; 206/443; 206/478; 206/483

[58] Field of Search ..... 206/45.18, 45.2, 362, 206/1.7, 45.19, 443, 485, 477–483

[56] References Cited

U.S. PATENT DOCUMENTS

| | | | |
|---|---|---|---|
| 4,117,930 | 10/1978 | Pave | 206/443 |
| 4,135,623 | 1/1979 | Thyen | 206/380 |
| 4,391,365 | 7/1983 | Batchelor | 206/380 |

*Primary Examiner*—Joseph Man-Fu Moy
*Attorney, Agent, or Firm*—Hauke & Patalidis

[57] ABSTRACT

A storage and display case having an open top enclosure formed of two portions hingedly connected at the middle of the enclosure. The hinged relation between the enclosure portions permits the enclosure to be supported in a V-shaped configuration between the sidewalls or end walls of an enclosure cover. One of the enclosure portions is provided with means for holding elongated objects, such as paintbrushes, in the form of a slotted frame affixed between the sidewalls of the enclosure portion and a row of clips or grippers. The slots in the frame progressively increase in width from one end of the frame to the other end thereof and the distance between the consecutive grippers in the row progressively increases in a corresponding manner.

4 Claims, 7 Drawing Figures

STORAGE AND DISPLAY CASE

BACKGROUND OF THE INVENTION

The present invention relates to a storage and display case which is particularly useful for storing and displaying the paintbrushes used by an artist, or other instruments or tools.

Prior art paintbrush storage or display apparatus fail to satisfy the several needs of an artist because they are only capable of effectively storing paintbrushes, or displaying them, but not both. For example, known paintbrush storing cases are in the form of rigid enclosures, without any convenient means being provided for supporting the enelosure in angular or substantially vertical position. Yet, an artist, while painting, needs to be able to readily survey his or her available paintbrushes and for this purpose it is preferable to have the paintbrushes disposed obliquely or substantially vertically. Prior art paintbrush display devices, on the other hand, are typically in the form of mere easels and are not provided with paintbrush holding means capable of securely storing away a plurality of paintbrushes within the device without risk of intermingling the paintbrushes. In fact, the holding means of known, easel type, paintbrush disply devices are not even convenient for an artist who, while painting, desires to periodically change paintbrushes because such holding means cannot accommodate a plurality of paintbrushes of several sizes, are not capable of securely retaining the individual paintbrushes at discrete positions within the device until selected by the artist for use, and do not permit any particular paintbrush to be easily removed from the holding means, when desired.

SUMMARY OF THE INVENTION

The present invention overcomes the disadvantages of the prior art by providing a paintbrush storing and display case having an enclosure, a cover for the enclosure and means for holding a plurality of paintbrushes. More particularly, the enclosure is formed of two hingedly connected portions and the paintbrush holding means is disposed in one of the enclosure portions.

When the case is being used for display purposes, the hinged enclosure is supported in a V-shaped configuration between the sidewalls or end walls of the enclosure cover such that the paintbrushes retained in the holding means are in an oblique or substantially vertical position. The novel holding means accommodates a plurality of paintbrushes of several sizes, and securely retains the individual paintbrushes in discrete positions until selected for use by an artist.

When the case is being used for storage purposes, the hinged enclosure is laid flat, paintbrushes are inserted in the holding means, and the enclosure cover is placed over and around the exterior periphery of the enclosure with a snug fit.

The many objects and advantages of the present invention will become apparent to those skilled in the art when the following description of the best modes contemplated for practicing the invention is read in conjunction with the accompanying drawing wherein:

DETAILED DESCRIPTION OF THE PREFERRED EMBODIMENTS

Figure 1:
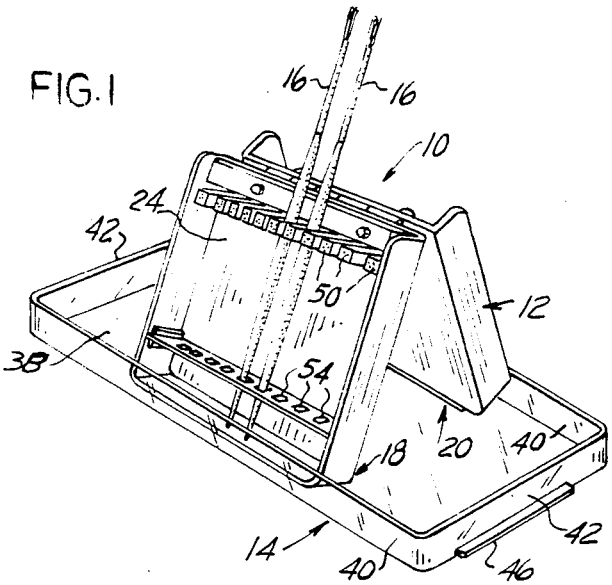
FIG. 1 is a perspective view of an example of a paintbrush storage and display case according to the invention wherein a hinged enclosure is angularly supported between the sidewalls of a transparent enclosure cover.
Figure 2:
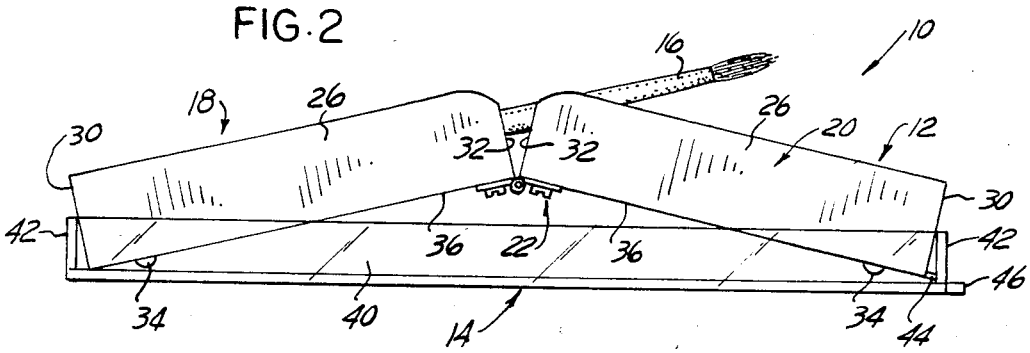
FIG. 2 is a side elevation view of the paintbrush storage and display case wherein the hinged enclosure is angularly supported between the end walls of the enclosure cover.

At FIGS. 1 and 2 of the drawing a paintbrush storage and display case 10, comprising an enclosure 12 and an enclosure cover 14, is shown as used for the purpose of displaying several paintbrushes 16 and at FIGS. 3–7 the storage and display case 10 is shown as used for storing the paintbrushes 16. In both applications, the paintbrushes 16 are retained in position by novel paintbrush holding means to be described in detail hereinafter.

The enclosure 12 of the storage and display case 10 is formed of two substantially identical, open top box portions 18 and 20 which are connected proximate the middle of the enclosure 12 by a transversely disposed hinge 22, such as a piano hinge, for example. Each box portion 18, 20 of the hinged enclosure 12 is preferably formed of thermoplastic resins and integrally molded as a single piece, having a bottom wall 24, a pair of sidewalls 26, 28 connected by an endwall 30, and an open end 32 disposed opposite the endwall 30. In addition, a reinforcing rib 33 extends across the upper surface 35 of each box portion bottom wall 24, and a pair of knobs or feet 34, protrude from the lower surface 36 of each box portion bottom wall 24.

The enclosure cover 14 of the storage and display case 10, which is transparent as shown, is also preferably formed of thermoplastic resins and integrally molded as a single piece, having a substantially rectangular planar wall 38 with sidewalls 40 and end walls 42 protruding at right angle along the respective edges of the planar wall 38. The length and width dimensions of the enclosure cover planar wall 38 permit the enclosure cover 14 to be snugly fitted over and around the exterior periphery of the hinged enclosure 12 when the storage and display device is being used for a storage purpose, FIGS. 3–7, with the enclosure 12 laid flat on an appropriate support surface, such as a table. The height dimensions of the enclosure cover sidewalls 40 and end walls 42 are sufficient to permit the enclosure cover 14 to act as a base for supporting the hinged enclosure 12 in a V-shaped configuration, either between the enclosure cover sidewalls 40, FIG. 1, or between the end walls 42 of the enclosure cover 14, FIG. 2. To adequately support the hinged enclosure 12 in this manner, the sidewalls 40 and end walls 42 of the enclosure cover 14 are preferably at least half as long as the end walls 30 of the enclosure box portions 18, 20.

One box portion 20 of the hinged enclosure 12 is further provided with a projecting lip 44 outwardly protruding from the bottom wall thereof and a similar lip 46 protrudes outwardly from the planar wall 38 of the enclosure cover 14. These lips 44, 46 permit separation of the connected enclosure cover 14 and enclosure 12, FIG. 3, by pressing the lips 44, 46 in opposite directions. The lip 44 also adds sufficient length to the hinged enclosure 12 to prevent it from collapsing into the enclosure cover 14, when the hinged enclosure 12 is being supported between the enclosure cover end walls 42, FIG. 2.

Referring again to FIG. 3, the means for holding a plurality of paintbrushes 16 comprises a slotted frame 48 affixed between the sidewalls 26, 28 the of enclosure box portion 18 and a row of paintbrush clips or grippers 50 disposed substantially parallel to the slotted frame 48. Each paintbrush 16 is retainable in the storage and display case 10 by passing the tip 52 thereof through a slot 54 in the frame 48 and pressing the paintbrush shaft 53 between consecutive paintbrush grippers 50.

Figure 4:
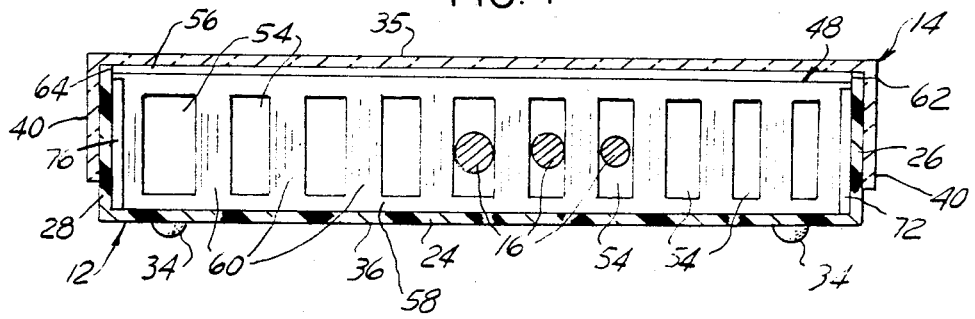
FIG. 4 is a sectional view along line 4—4 of FIG. 3.

The slotted frame 48, which is shown in detail at FIG. 4, is preferably formed integrally as a single piece having two longitudinal rail portions 56, 58 extending in parallel and a plurality of constant-width, transverse slats 60 interconnecting the rail portions 56, 58 at spaced apart intervals. The slots 54 in the frame 48 are formed between consecutive slats 60 and are of progressively increasing width from one end 62 of the frame 48 to the other end 64 thereof.

The slotted frame 48 is affixed between the enclosure box sidewalls 26, 28 by the respective ends 62, 64 of the frame 48 being inserted into notches 66, 68. As shown, each notch 66, 68 is formed between two sidewall projections 70, 72 and 74, 76 respectively, and the frame ends 62, 64 are secured in the notches 66, 68 by any appropriate means, such as a dimple and groove arrangement for example, or by cementing or gluing. If desired, the projections 70–76 can be omitted with the notches 66–68 formed directly in the enclosure box sidewalls 26, 28.

Figure 5:
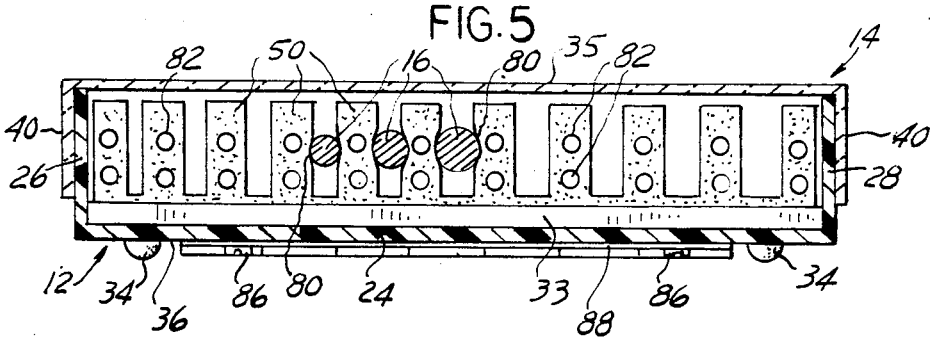
FIG. 5 is a sectional view along line 5—5 of FIG. 3.
Figure 6:
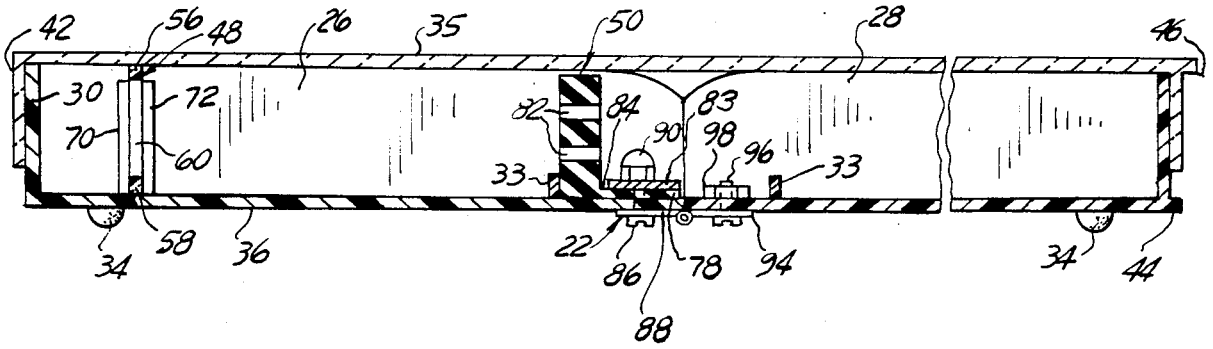
FIG. 6 is a sectional view along line 6—6 of FIG. 3.

The row of paintbrush grippers 50, as shown in detail at FIGS. 5 and 6, is preferably formed of a single piece of compressible, deformable and resilient material, such as a thermoplastic elastomer, for example, wherein the spaced-apart grippers 50, in the form of rectangular blocks, integrally protrude at right angle along one edge of a rectangular base portion 78. Forming the paintbrush grippers 50 of compressible, deformable and resilient material permits consecutive grippers 50 to spread apart slightly, if necessary, when the shaft 53 of a paintbrush 16 is pressed between them and also permits the mid portion of each gripper 50 to be slightly inwardly compressed, as shown at 80, for securely holding the paintbrush shaft 53 between consecutive grippers 50. To allow even greater deformation and resiliency, each gripper 50 preferably has at least one transverse bore 82 formed therethrough, with two such bores 82 through each gripper 50 being shown in the drawings.

A further important aspect of the row of paintbrush grippers 50 is that the distance between consecutive grippers 50 in the row progressively increases from one end of the row to the other, and it will be appreciated that the progressive increase in distance between grippers 50 forming the row corresponds to the progressive increase in size of the slots 52 in the frame 48. As a result, the paintbrush holding means is able to hold a plurality of paintbrushes of varying diameter in discrete positions within the enclosure box portion 18. This feature is improved by the grippers 50 being configured to readily spread apart, and deform inwardly at the middle, thereby allowing the grippers 50 to accept various paintbrush shafts 53 of slightly different diameters.

Figure 3:
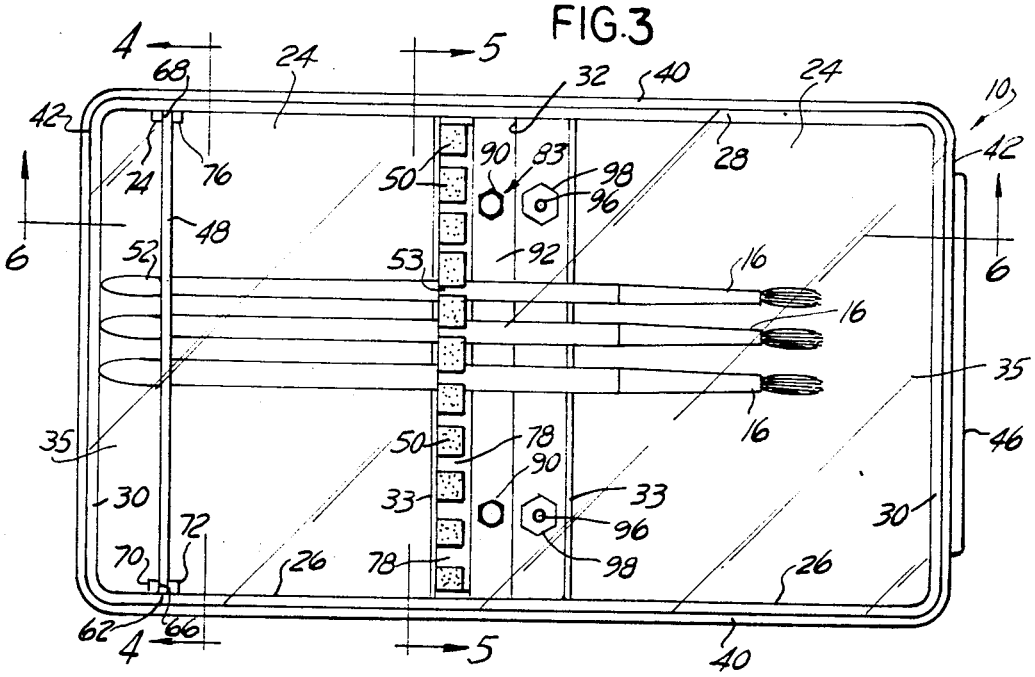
FIG. 3 is a top plan view showing the hinged enclosure cover laid flat with the enclosure cover fitted thereover.

The base portion 78 of the clip row is fastened to the top surface 35 of the enclosure box portion bottom wall 24, with one longitudinal edge 80 of the base portion 78 abutting the reinforcing rib 33. One type of fastening means for the base portion 78 is shown at FIGS. 3 and 6 in the form of a rectangular plate 83 having length and width dimensions corresponding to those of the top surface 84 of the base portion 78. Two bolts 86 are passed through aligned bores in one leaf 88 of the hinge 22, the bottom wall 24 of the enclosure box portion 18, the base portion 78 of the clip row and the plate 83. The plate 83 is firmly applied against the top surface 84 of the base portion 78 by nuts 90 threaded over an end of the bolts 86 and drawn into engagement with the top surface 92 of the plate 83.

It is apparent that the bolts 86 and nuts 90 also serve to apply the hinge leaf 88 against the bottom surface 36 of the enclosure bottom wall 24. The other leaf 94 of the hinge 22 is preferably applied against the bottom surface 36 of the enclosure bottom wall 24 in a similar fashion, namely by two bolts 96, each bolt 96, respectively, being passed through aligned bores in the bottom wall 24 of the enclosure box portion 20 and the hinge leaf 94, with each bolt 96 having a nut 98 threaded thereover and drawn into engagement with the bottom wall 24 top surface 35.

Figure 7:
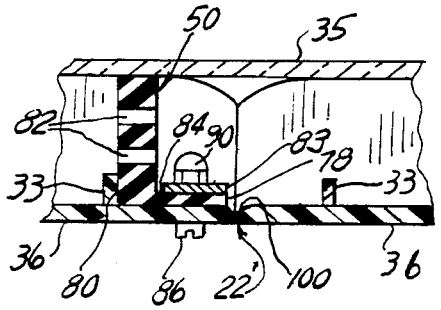
FIG. 7 is a view of a portion of FIG. 6 but showing a modification wherein the hinged enclosure cover is provided with an integral or living hinge.

FIG. 7 shows an alternative arrangement wherein the piano hinge 22 is omitted and replaced by an integral or living hinge 22'. In this configuration, the respective box portions 18, 20 of the hinged enclosure 12 are formed, for example, of a single piece of material, with a V-shaped groove 100 formed in the bottom wall 24 of the enclosure 12, extending between the sidewalls 26, 28 thereof. Bolts 86 and nuts 90 hold the plate 83 against the top surface 84 of the gripper row base portion 78 as in FIG. 6, except that the bolts 86 are not passed through a hinge leaf. It will be understood that other integral or living hinge arrangements could be substituted.

Although the paintbrush storage and display case has been illustrated as used for paintbrushes, it will be understood that the case is suitable for storing and displaying other instruments or tools, such as medical and surgical instruments, manicurist files, jewelers tools, screwdrivers and the like.

Having thus described the present invention by way of structural examples thereof, modifications whereof will be apparent to those skilled in the art, what is claimed as new is as follows:

1. A storage and display case comprising a substantially rectangular open top enclosure, a substantially rectangular cover for said enclosure, said cover having a peripheral wall formed by a pair of parallel spaced-apart longitudinal sidewalls and a pair of parallel spaced-apart endwalls, and means for holding a plurality of elongated objects in said enclosure, said enclosure comprising a pair of hingedly connected portions each having a bottom wall and a pair of spaced-apart sidewalls connected by an endwall, wherein said means for holding a plurality of elongated objects comprises a slotted frame affixed between the sidewalls of one of said enclosure portions, said slotted frame having two substantially parallel spread-apart rail portions and a plurality of slats integrally interconnecting said rail portions at spaced-apart intervals, and a row of grippers disposed substantially parallel to said slotted frame and formed of a single piece of compressible, deformable and resilient material having spaced-apart projecting portions, at least one bore extending transversely through each of a pair of adjoining projecting portions for locally increasing the compressible deformation of said adjoining projecting portions when laterally elastically gripping an elongated object placed therebetween, whereby said enclosure is adapted for placement within the upturned cover in a hinged position with the endwalls of said enclosure portions abutting the longitudinal sidewalls of the cover and at least one of said elongated objects gripped between a pair of adjoining gripper projecting portion, an end of said elongated object being held between a pair of adjacent slats on said slotted frame.

2. The storage and display case of claim 1 wherein said enclosure portions are hingedly connected by a living hinge.

3. The storage and display case of claim 1 wherein the slats interconnect said rail portions at progressively increased spaced-apart intervals and said gripper spaced-apart projection portions are separated by a distance progressively increasing from one end of said row of grippers to the other end thereof.

4. The storage and display case of claim 2 wherein the slats interconnect said rail portions at progressively increased spaced-apart intervals and said gripper spaced apart projection portions are separated by a distance progressively increasing from one end of said row of grippers to the other end thereof.

* * * * *